United States Patent [19]

Yaindl

[11] 4,239,463

[45] Dec. 16, 1980

[54] RECIPROCATING PLUNGER PUMP WITH IMPROVED LIQUID END VALVE ASSEMBLY

[75] Inventor: Charles Yaindl, Harrison, N.J.

[73] Assignee: Worthington Pump, Inc., Mountainside, N.J.

[21] Appl. No.: 946,557

[22] Filed: Sep. 28, 1978

[51] Int. Cl.[3] ..... F04B 21/00; F04B 39/08

[52] U.S. Cl. ..... 417/454; 417/539

[58] Field of Search ..... 417/454, 567, 569

[56] References Cited

U.S. PATENT DOCUMENTS

| | | | |
|---|---|---|---|
| 3,106,169 | 10/1963 | Prosser et al. | 417/569 |
| 3,114,326 | 12/1963 | Yaindl | 62/55 |
| 3,206,110 | 9/1965 | Waibel | 417/567 |
| 3,260,217 | 7/1966 | Thresher | 417/569 |
| 3,309,013 | 3/1967 | Bauer | 417/567 |
| 3,309,014 | 3/1967 | Bauer | 417/567 |
| 3,508,849 | 4/1970 | Weber | 417/454 |
| 3,510,233 | 5/1970 | Strebel | 417/454 |
| 3,702,624 | 11/1972 | Fries | 417/567 |
| 3,820,922 | 6/1974 | Buse | 417/539 |

FOREIGN PATENT DOCUMENTS

| | | | |
|---|---|---|---|
| 2711837 | 6/1978 | Fed. Rep. of Germany | 417/454 |

*Primary Examiner*—William L. Freeh

*Attorney, Agent, or Firm*—Daniel H. Bobis

[57] ABSTRACT

A reciprocating plunger pump particularly adapted for the pumping of liquids has at least one pumping chamber and a plunger disposed for reciprocating movement therein, a common substantially integral inlet manifold for fluid to be pumped, a common integral outlet manifold for pumped fluid, and a valve assembly operatively associated and aligned with the pumping chamber and connected to the inlet manifold to receive the fluid to be pumped and to deliver the fluid to the pumping chamber, and operatively connected to the outlet manifold to pass the pumped fluid thereto. The valve assembly has cylindrical pressure containing parts including, a lower section, an intermediate section, and an upper section with a discharge passage extending end to end therethrough in the longitudinal axis of and in communication with the pumping chamber in the assembled position of the valve assembly. The intermediate section of the valve assembly has a two piece suction inlet assembly having a portion of the discharge passage in the axial line thereof forming a first port, and the suction inlet assembly is mounted so as to define suction inlet passages, a second port as a suction inlet, and a suction inlet valve seat, all disposed concentric, parallel and radially outward of the discharge passage. The lower section has an inlet chamber and a spring loaded valve head is disposed in the inlet chamber for engagement with the suction inlet valve seat to maintain the suction inlet valve port normally closed and the valve head is movable from closed to open position responsive to movement of the plunger in the pumping chamber. The upper section has the discharge outlet assembly mounted therein remote from and independent of the suction inlet assembly to provide a discharge valve port having a discharge valve seat and a spring loaded discharge valve head is operative to engage the discharge valve seat to maintain the discharge port normally closed and is also movable to open position on movement of the plunger. The suction inlet assembly and discharge outlet assembly respectively are taper driven for mounting the same in the valve assembly and their structure and assembly permit relatively easy repair thereof in the event of failure, and respectively the gasketing thereof against the high pressures acting in the fluid being pumped.

9 Claims, 11 Drawing Figures

RECIPROCATING PLUNGER PUMP WITH IMPROVED LIQUID END VALVE ASSEMBLY

BACKGROUND OF THE INVENTION

This invention relates generally to reciprocating plunger pumps for pumping liquids and more particularly to an improved liquid end valve assembly wherein the suction inlet assembly and discharge outlet assembly are designed and constructed to provide a reciprocating plunger pump with improved pumping capacity.

Conventional T-head liquid end valve assemblies wherein the suction inlet valves and discharge outlet valves are disposed in heads so that the fluid flow paths therethrough were perpendicular to the axis of the pumping chambers in the cylinder heads of the reciprocating plunger pumps, experienced failures due to the stress concentrations created in the liquid end of the reciprocating plunger pumps.

This is more fully explained and set forth in U.S. Pat. No. 3,114,326 in respect of these problems at high operating pressures.

In U.S. Pat. No 3,114,326 a construction is shown for eliminating these stress concentrations at the intersecting bores by providing a liquid end having suction inlet valves and discharge outlet valves wherein the fluid flow therethrough is in alignment with the longitudinal axis of the respective associated pumping chambers. Similar efforts are shown in U.S. Pat. Nos. 3,106,169, 3,260,217, 3,309,014 and 3,702,624.

The present invention also has an aligned and coaxial suction inlet assembly and discharge outlet assembly for each respective liquid end valve assembly so that the associate suction inlet valve head and discharge outlet valve head are movable substantially parallel to and/or coaxial with the associated plunger of the multi-plunger reciprocating pump to provide improved inlet characteristics for the suction inlet assembly, maximum free flow of fluid being pumped therethrough and natural venting of air or gases through the discharge outlet assembly, and which further provides a higher compression ratio for the pumping chamber.

The suction inlet assembly is formed in two parts and therefore can be readily machined with relatively large passages therethrough to provide maximum inlet flow area with minimum radial space requirements. The two part element can be assembled and joined so as to provide a tapered outer surface for removably connecting the suction inlet assembly in the associate cylindrical containing parts of the valve assembly in which it is mounted by a taper driven fit.

The discharge outlet assembly also has a tapered outer surface for removably connecting the discharge outlet assembly into assembled position in the annular cylindrical containing parts of the associated valve assembly in which it is mounted also by a taper driven fit.

The construction of the valve assembly and the tapered connection for the suction inlet assembly and discharge outlet assembly are less costly to manufacture, simplify repair of the suction inlet valve or discharge outlet valve in the event of failure, and permit independent gasketing of critical areas of the valve assembly against the high pressure of the fluid being pumped.

SUMMARY OF THE INVENTION

Thus the present invention covers an improved reciprocating plunger pump having at least one cylinder having a pumping chamber therein and a plunger connected for reciprocating movement in said pumping chamber, a common inlet manifold for delivering fluid to the pump, a common outlet manifold for passing the pumped fluid from said reciprocating plunger pump, and a valve assembly means connected to said pump for operative association with the pumping chamber has a discharge passage extending end to end therethrough in communication with and in the longitudinal axis of the pumping chamber including, multi-element suction inlet assembly means removably connected in said valve assembly means and having a portion of said discharge passage extending therethrough, said suction inlet assembly means having, suction inlet passages radially outward, concentric and parallel to the discharge passage and a suction inlet port, said suction inlet passages communicating at one end with the common inlet manifold to receive fluid to be pumped and at the opposite end with the suction inlet port to deliver the fluid to be pumped to the pumping chamber, suction inlet valve head means disposed to normally maintain the suction inlet port closed and movable to open position on downward reciprocation of the plunger, an independent discharge outlet assembly removably connectd in said valve assembly at the end of the discharge passage remote from the pumping chamber and defining a discharge port in communication with the common outlet manifold for delivering pumped fluid thereto, and a discharge outlet valve head means disposed to normally maintain the discharge port closed and movable to open position on upward reciprocation of the plunger.

The improved valve assembly has a reciprocating plunger pump as above described wherein the suction inlet valve assembly and discharge outlet valve assembly have tapered outer surfaces and are connected to tapered mating bores in the valve assembly.

Accordingly, it is an object of the present invention to provide an improved multi-plunger reciprocating pump in which the liquid end valve assemblies are constructed and arranged in parallel alignment with the pumping chamber and plunger so as to better withstand the stresses of pumping action at all pressures.

It is another object of the present invention to provide an improved multi-plunger reciprocating pump wherein the liquid end valve assemblies respectively have cylindrical pressure containing parts and are fastened together and sealed in assembled position to provide a fluid tight containment means against varying pressures that can develop in the liquids being pumped.

It is another object of the present invention to provide an improved multi-plunger reciprocating pump wherein the liquid end valve assembly has maximum free flow through the suction inlet valve with minimum radial space requirements, and natural venting of air or gases through the discharge outlet valve.

It is another object of the present invention to provide an reciprocating plunger pump with an improved compression ratio for the pumping chamber.

It is another object of the present invention to provide an improved reciprocating plunger pump wherein the suction inlet valve seat and discharge outlet valve seat form part of a suction inlet assembly and discharge outlet assembly which are taper mounted in assembled position in their respective valve assemblies to permit easy repair thereof in the event of failure, and the respective suction inlet valve and discharge outlet valve are independently sealed and gasketed against the varying pressures that the liquids can develop during pumping operation thereof.

These and other objects will be better understood by referring to the following description and claims taken in conjunction with the attached drawings, in which:

Figure 3:
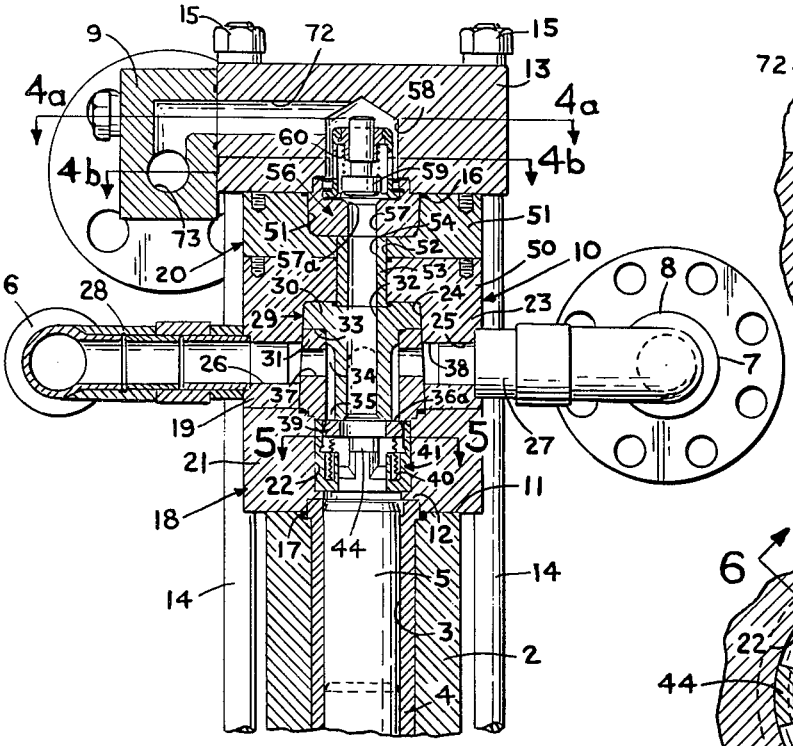
FIG. 3 is a vertical section of one of the liquid end valve assemblies as shown in FIGS. 1 and 2.
Figure 4A:
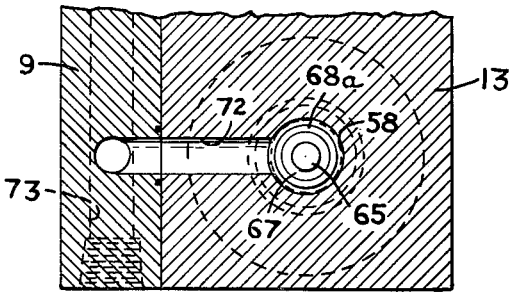
Figure 4B:
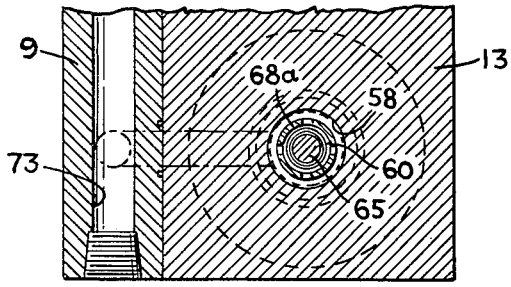

FIG. 4*a* and 4*b* are horizontal sections taken on lines 4*a*—4*a* and 4*b*—4*b* respectively on FIG. 3.

Figure 5:
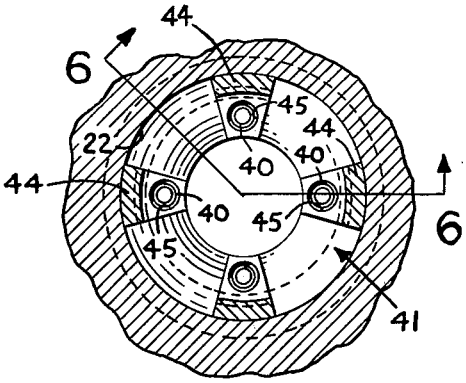

FIG. 5 is a cross-section taken on line 5—5 on FIG. 3.

Figure 6:
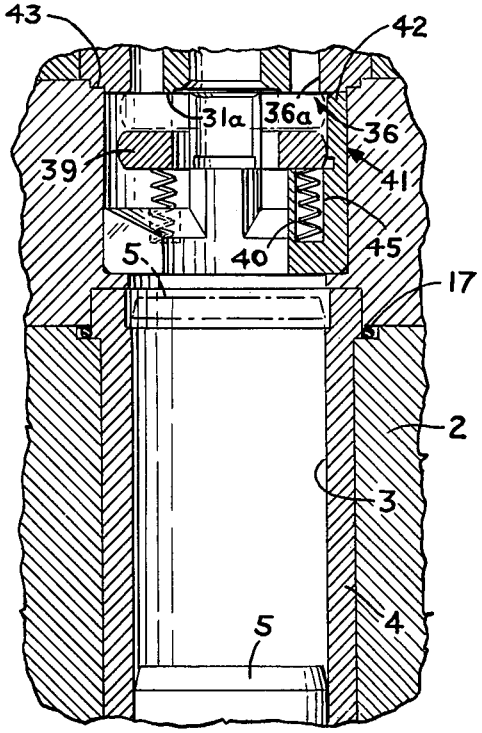

FIG. 6 is an enlarged vertical section of the suction inlet assembly showing the valve seat and the suction inlet valve head in open position in solid lines and in closed position in phantomized lines.

Figure 7:
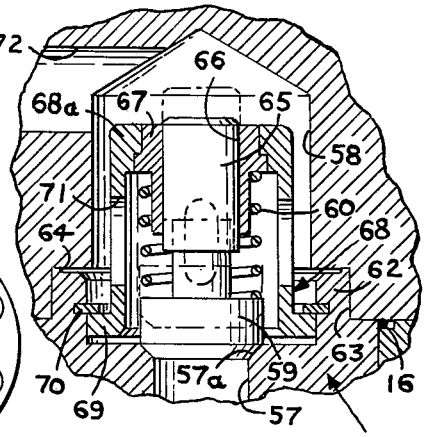

FIG. 7 is an enlarged vertical section of the discharge outlet assembly showing the discharge outlet valve seat and the discharge valve head in closed position in solid lines and in open position in dotted lines.

Figure 8:
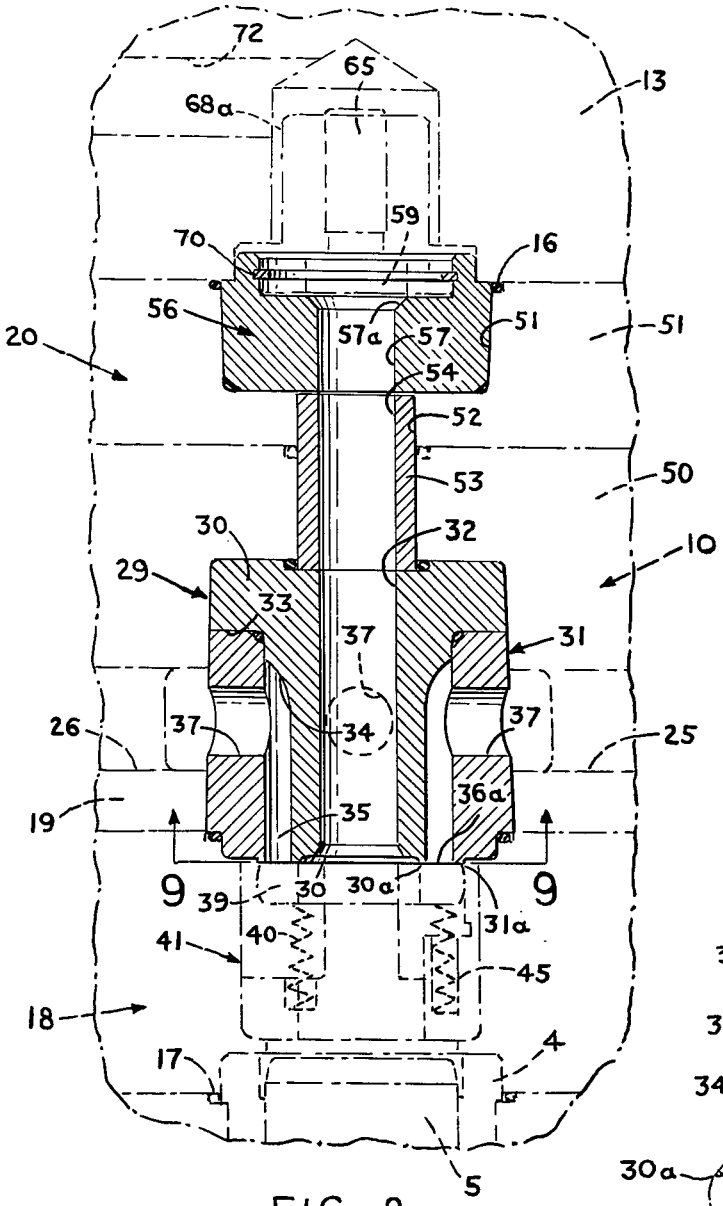

FIG. 8 is an enlarged view of one valve assembly.

Figure 9:
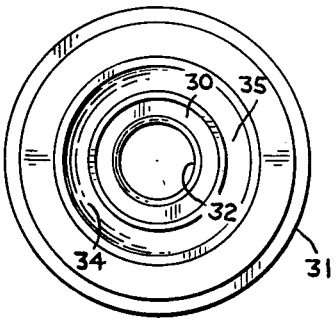

FIG. 9 is a bottom view of the section inlet valve seat taken on line 9—9 of FIG. 8.

Figure 10:
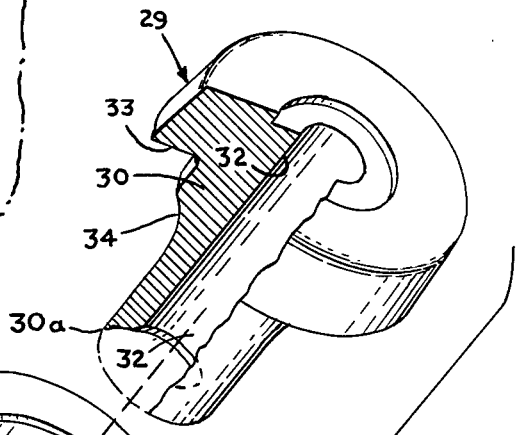
Figure 10:
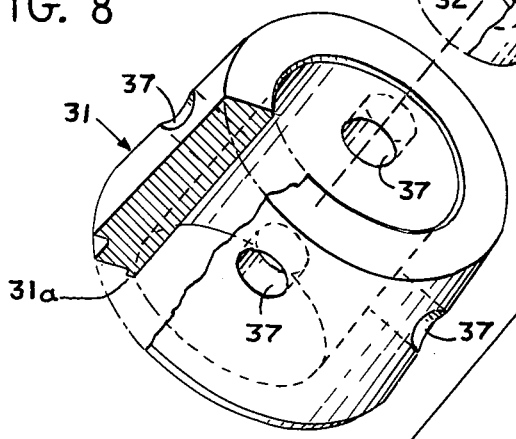

FIG. 10 is an enlarged exploded view of the suction inlet assembly.

Referring to the drawings FIGS. 1 to 4 show a reciprocating plunger pump generally designated 1 having at least one or more pump cylinders as at 2 on which are connected liquid end valve assemblies generally designated 10 in accordance with the present invention.

Each cylinder 2 defines a pumping chamber 3 having a cylinder liner 4 made of bronze or the like material and a plunger 5 is slidably mounted for reciprocating movement in the longitudinal axis of the pumping chamber 3 by suitable driving means, not shown, disposed in the base 6 of the reciprocating plunger pump 1.

In FIG. 4 the plunger 5 is shown at the upper end of its stroke in solid lines and at the lower end of its stroke in dotted lines.

The means for connecting the end of the plunger remote from the liquid end valve assembly 10 to the driving or operating mechanism for reciprocating the plunger are well known to those skilled in the art and is therefore not more fully described or shown herein.

In the illustrated reciprocating plunger pump the pump chambers are generally vertically oriented and liquid end assemblies which contain both the suction inlet valves and the discharge outlet valves as will be more fully described below, communicate with the upper end of an associated pumping chamber to permit natural venting of air or other non-condensible gases during the operation of the reciprocating plunger pump 1. Further the liquid end valve assemblies for the respective pumping chamber 3 are designed to communicate with common suction manifolds 6 and 7 disposed on opposite sides of the liquid end valve assembly in turn mounted and connected to the main inlet 8 for the fluid to be pumped and to a common discharge manifold 9 for delivering the pumped fluid to the desired point of use.

In operation fluid to be pumped enters through the main inlet 8 passes through the suction manifolds 6 and 7 to the liquid end valve assemblies 10 and as the plungers 5 are reciprocated the fluid to be pumped is drawn in through the respective suction inlet valves and pumped through the discharge outlet valves hereinafter to be described and thence to the discharge manifold 9 where the pumped fluid is then passed to any suitable point of use.

LIQUID END VALVE ASSEMBLIES

The liquid end valve assemblies are identical in construction and therefore only one of said valve assemblies is illustrated at FIGS. 3 to 10 of the drawings.

Figure 1:
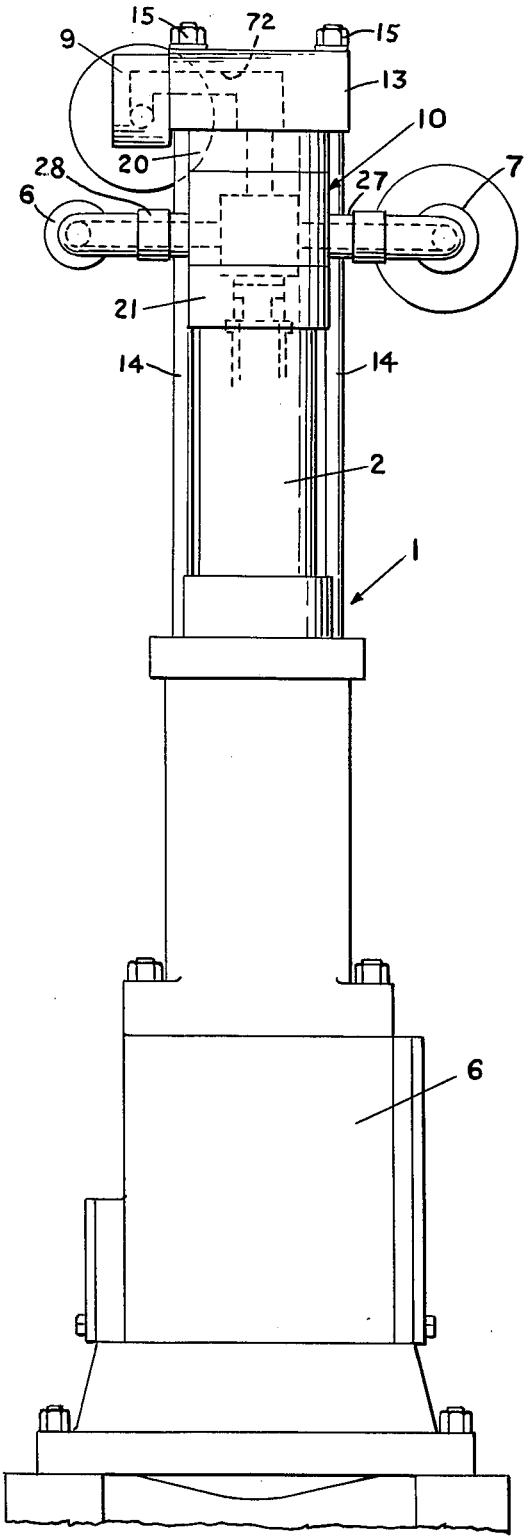
FIG. 1 is a side view of a vertical type reciprocating plunger pump having a plurality of liquid end valve assemblies in accordance with the present invention.
Figure 2:
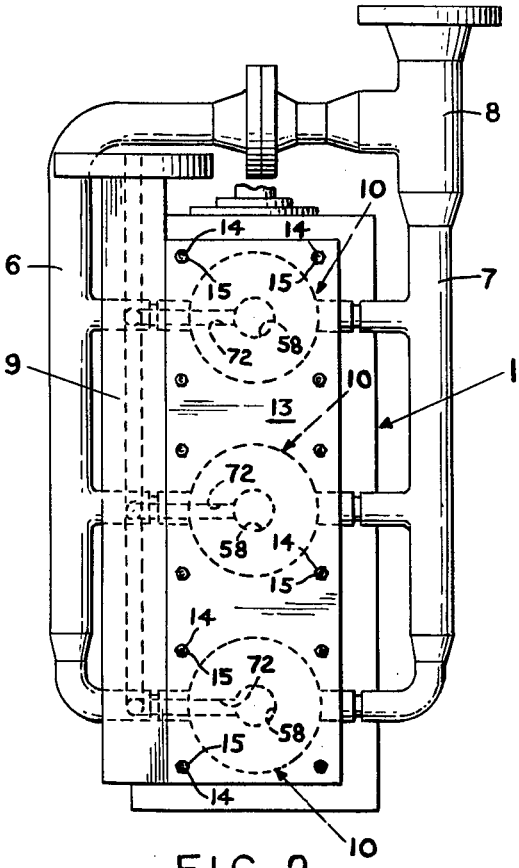
FIG. 2 is a top plan view of the reciprocating plunger pump shown in FIG. 1.

The respective valve assemblies 10 as shown in FIGS. 1, 2 and 3 of the drawings are cylindrical in plane view and are each held in engagement with the upper face 11 of the associated cylinder 2 and the upper face 12 of the associated cylinder liner 4 by a common discharge head 13. Discharge head 13 is connected by elongated rods 14 which extend up from the base 6 through the discharge head 13 so that nuts as at 15 can be connected to the threaded ends thereof to pull the discharge head and the valve assemblies 10 into tight engagement with their associated cylinders and cylinder liners so as to withstand the high pressures ranging up to 50,000 P.S.I.G. at which reciprocating plunger pumps of the type shown herein operate. The respective valve assemblies 10 are further provided with upper O-ring seals at 16 and O-ring seals as at 17 to form fluid tight joints between the annular cylinders 2 and the common discharge head 13.

In FIGS. 3 and 5 to 10 only one of the valve assemblies 10 is shown and includes a lower section 18, an intermediate section 19 and an upper secton 20 which define suction inlet passage means, suction inlet valve seats, an axially extending and centrally located discharge passage means, and a discharge valve seat.

Lower section 18 has an annular lower outer element 21 which defines a cylindrical inlet chamber 22 disposed in alignment with and in communication at the lower end thereof with the pumping chamber 3 of its associated cylinder 2 to permit pumped fluid to pass freely therethrough to and from the pumping chamber 3.

The intermediate section 19 between the lower section 18 and upper section 20 has an annular intermediate outer element 23 which defines a centrally located cylindrical cavity or suction inlet assembly space 24 in communication with the upper end of the inlet chamber 22 and in alignment with the inlet chamber 22 and the pumping chamber 3.

The annular intermediate outer element 23 has radially disposed inlet ports 25 and 26 spaced therein on opposite sides of the intermediate outer element 23 so as to connect with one end of the conduits 27 and 28 which are in turn connected at their remote ends to the respective inlet manifolds 6 and 7. Thus, fluid to be pumped from the main inlet 8 will pass freely through the respective side inlet manifolds 6 and 7 and through conduits 27 and 28 to the inlet ports 25 and 26 of the respective valve assemblies 10, all of which is shown in FIGS. 1 to 3 and 7.

The cylindrical cavity or suction inlet assembly space 24 is tapered or cone shaped. Removably mounted in the respective centrally disposed cylindrical cavities 24 of the valve assemblies 10 is a two piece suction inlet assembly generally designated 29. The suction inlet assembly 29 has an inner cylindrical member 30 and a coacting thimble member 31 disposed about the inner cylindrical member 30 and these members are operatively associated so as to form the suction inlet passages, suction inlet port and suction inlet valve seat as will now be described.

Thus, FIGS. 3, 8, and 10 show that the inner cylindrical member 30 has a portion 32 of the discharge passage means defining a first port extending end to end therethrough which in the assembled position of the combined assembly is disposed in the axial line of the pump chamber 3 and in communication with the end of the inlet chamber 22 remote from the pumping chamber 3. Thus, fluid being pumped can pass freely through the inlet chamber 22 to this initial portion 32 of the discharge passage means.

Inner cylindrical member 30 has the outer peripheral face thereof, cut, or formed to provide an L-shaped shoulder as at 33 and an annular groove as at 34 which extends from the L-shaped shoulder 33 downwardly to the lower end or lower face of the inner cylindrical member 30. Annular thimble element 31 is sized to fit into snug engagement with the L-shaped shoulder 33 and about the grooves 34 and these elements of the suction inlet assembly 29 are shaped on their outer surfaces when assembled so that in side elevation the combined suction inlet assembly 29 has a tapered mating diameter to permit the suction inlet assembly 29 to be removably fitted into the tapered wall of the cylindrical cavity 24 as is shown in FIG. 4 of the drawings.

In assembled position the annular thimble 31 defines with the axially extending groove 34 on the inner cylindrical member 30 a relatively wide axially extending suction inlet passage 35 and at the lower ends an inner projection 30*a* and an outer projection 31*a* on the respective inner cylindrical element 30 and thimble element 31 from an annular valve seat 36 about an annular suction inlet valve port as at 36*a*. The suction inlet passages 35 and suction inlet valve port 36*a* lie radially outward, concentric and parallel to the inlet portion 32 of the discharge passage.

Radial ports as at 37 are formed through the wall of the annular thimble 31 so as to communicate at one end with the upper end of the suction inlet passage 35 and at the opposite end with an annular groove 38 formed on the tapered inner wall of the cylindrical cavity 24.

The inlet ports 25 and 26 respectively communicate with the annular groove 38 and thus liquid to be pumped is passed from the annular groove 38 through the radial passages 37, suction inlet passage 35 to the suction inlet port 36*a*. Flow of the fluid to be pumped through from the suction inlet port 36*a* into the inlet chamber 22 is controlled by a suction inlet valve head 39 which is disposed to normally close the suction inlet port 36*a* all of which is shown in FIGS. 4 and 6 of the drawings.

FIGS. 3 and 6 show that the suction inlet valve head 39 is maintained normally closed by a plurality of resilient elements or springs 40 mounted in a spring supporting spider 41, in turn held in assembled position in the inlet chamber by the force exerted against the upper end 42 of the spring supporting spider 41 by the lower end 43 of the annular thimble element 31.

The spring supporting spider 41 is annular in shape and has an outer diameter to permit it to fit snugly in the inlet chamber 22 and an inner diameter substantially larger than the portion 32 of the discharge passage so that fluid being pumped can pass freely through the spider 41 and inlet chamber 22 to the discharge passage. Further the spider 41 has a plurality of spaced bosses thereon as at 44 which are provided with bores 45 therein in which are mounted respectively the springs 40. In assembled position, springs 40 at their lower end engage the bottom of the closed bores 45 in the spaced bosses 44 and at their upper end are in engagement with the lower face of the suction inlet valve head 39 so that they maintain the suction inlet ports 36 normally closed as is shown in FIG. 4 of the drawings and can move to open position on downward movement of the plungr 5 as shown in FIG. 6 of the drawings.

When the plunger 5 moves downwardly in the pumping chamber 3 liquid to be pumped will act to force the suction valve head 39 to open position and the fluid to be pumped will pass freely from the inlet 8 through the manifold 6 and 7, connecting conduits 27 and 28, inlet ports 25 and 26, radial passages 37 and suction inlet passage 35 through the suction inlet port 36 to the inlet chamber 22 and pump chamber 3 of the reciprocating plunger pump 10 until the plunger 5 reaches its lowest extremity as shown by the dotted line in FIG. 4 and the solid line in FIG. 6 of the drawings.

On such downward motion the suction inlet valve head compresses the springs 40 so that when the reciprocating plunger 5 reverses its direction of movement the pressure of the liquid being pumped taken with the compressed forces stored in the springs 40 will act to return in suction inlet valve head 39 to the position where it maintains the suction inlet ports 38 normally closed and the fluid being pumped will thereafter be delivered through the discharge passage 32 in the inner cylindrical member 30.

The upper section 20 has an upper annular outer element 50 which also defines a second centrally disposed cylindrical cavity as at 51 having an enlarged bore therein as at 52 continues with the bore 52*a* at the upper end of the intermediate section 19 in which a cylindrical liner and spacer 53 is disposed. Cylindrical liner and spacer 53 has a bore 54 end to end therethrough which is in alignment and communicates with the upper end of the portion 32 of the discharge passage.

The second cylindrical cavity 51 is the discharge outlet assembly space and is concentric with the axial line of the discharge bore 54 in the cylindrical lines and spacer 53. The discharge outlet assembly space 51 has a tapered or conical shaped wall and receives therein the discharge outlet assembly generally designated 56 which is a cylindrical member having a tapered outer wall designed to fit and mate with the tapered wall of the discharge outlet assembly space 51. It will be clear that the purpose of the enlarged bore 52 is to enable access to the discharge outlet assembly 56 when it is necessary to remove the same for any reason. A suitable tool mounted therethrough can be used to drive the discharge outlet assembly 51 from its assembled position.

The discharge outlet assembly 56 has a discharge port 57 which is an alignment with the discharge passage 32 and discharge bore 54. At the upper end thereof the discharge port 57 communicates with the discharge chamber 58 formed in the common discharge head 13 for each respective associated valve assembly 10.

A discharge valve seat at 57*a* is formed about the discharge port 57 and coacts with a discharge valve head 59 which is mounted in the discharge chamber 58. The discharge valve head 59 is actuated by a spring member 60 which acts to normally urged the discharge valve head 59 into engagement with the discharge valve seat 57*a* so as to maintain the discharge port 57 closed.

The discharge outlet assembly 56 has an annular flange 62 which extends into a circular groove 63 formed in the common discharge head 13 concentric with the discharge chamber 58 for the associated valve assembly 10. An annular sealing ridge 64 is provided to establish a fluid tight seal between the discharge valve outlet assembly 56 and the common discharge head 13 in assembled position as is shown in FIG. 7 of the drawings.

The discharge valve head 59 is connected to the valve stem 65 which is slidably disposed in a bore 66 in the valve guide 67. Valve guide 67 is in turn mounted and connected to the upper end of a discharge valve spring cage 68. The discharge valve spring cage 68 is a cup shaped member having an annular flange 69 about the open end thereof and is held in inverted position by a snap ring 70 which engages the annular flange 69 thereon.

The discharge valve spring 60 is held within the cup shaped discharge valve spring cage 68 so tht one end thereof abuts the closed end 68*a* of the discharge valve spring cage and the other end is in abutment with the discharge valve head 59, the resiliency of the spring 60 acting to force the discharge valve head so as to engage the discharge valve seat 58 and maintain the discharge valve port 56 closed.

Further the discharge valve spring cage is shown as provided with a plurality of openings as at 71 in the sides thereof so that fluid discharging through the discharge valve port 57 will pass freely through the opening 71 into the discharge chamber 58 for the associated valve assembly 10.

Thus when the plunger 5 moves upwardly and exerts pressure on the fluid being pumped in the inlet chamber 22, the fluid passes through the discharge passage 32, discharge bore 54 to the discharge 57 where acting against the discharge valve head 59 it forces the same open and passes through the openings 71 into the discharge chamber 58 for the associated valve assembly 10.

Each of the respective discharge chambers 58 for a given valve assembly 10 communicates with a discharge outlet passage 72 which in turn communicates with the common discharge outlet 73 in the common discharge manifold 9 for the reciprocating plunger pump 1.

OPERATION

In operation the inlet 8 is connected to the source of fluid (not shown) to be pumped and when the plunger 5 is reciprocated in a downward direction the fluid to be pumped is drawn through the inlet 8 and the suction manifold 6 and 7 to the inlet ports 25 and 26 where it passes through the suction inlet passages 35 and the suction inlet port 36 as the suction inlet valve 39 is moved to open position so as to fill the inlet chamber 22 and the pump chamber 3.

When the plunger 5 reverses its direction of movement the suction inlet valve 39 is closed as above described and the fluid under the pressures exerted by the plunger 5 is forced through the discharge passage 32, discharge bore 55 and discharge port 56 to the discharge chamber 57 and then passes through the discharge outlet 72 and common discharge outlet 73 for discharge from the common discharge manifold to use.

Thus, an improved liquid end assembly has been described which is capable of withstanding high impact loading by reason of the cylindrical containment characteristics of the outer elements and by reason of the taper driven connections of the respective independent suction inlet assembly and discharge outlet assembly provides a simpler, cheaper and quicker means for effecting repair of these elements in the event of failure.

Further, the two piece suction inlet assembly provides greater versatility in the design of the suction inlet passages and the suction inlet port in that it permits establishing relatively larger flow access without increasing the radial space requirements and permits variations of these flow areas within the radial space limits available for each given size of the reciprocating plunger pump.

Seals as illustrated between the elements of the improved liquid and valve assembly are provided to further insure against the by-passing of pumped liquid about the taper driven connection for the suction inlet assembly and discharge outlet assembly.

It will be understood that the invention is not to be limited to the specific construction or arrangement of parts shown but that they may be widely modified within the invention defined by the claims.

What is claimed is:

1. In a reciprocating plunger pump having, at least one pumping chamber, a plunger connected for reciprocating movement in said plunger chamber, common inlet manifold means for delivering fluid to be pumped, common outlet manifold means for passing pumped fluid from said reciprocating plunger pump, and valve assembly means having a discharge passage extending end to end therethrough connected to said plunger pump for communication with and in the longitudinal axis of the pumping chamber, a. multi-element suction inlet assembly means removably connected in said valve assembly means and having the end of said discharge passage adjacent the pump chamber extending therethrough, b. said suction inlet assembly means having, a suction inlet passage radially outward, concentric to and parallel to said pumping chamber end of the discharge passage and having one end connected to the inlet manifold means to receive fluid to be pumped therefrom and communicating at the opposite end with means on the suction inlet assembly means defining a suction inlet port for delivering the fluid to be pumped to the pumping chamber, c. suction inlet valve head means disposed to normally maintain said suction inlet port closed and movable to open said suction inlet port on downward movement of said plunger, and d. an independent discharge outlet assembly removably connected in said valve assembly means at the end of the fining a discharge port in communication with the outlet manifold for delivering pumped fluid thereto, and e. discharge outlet valve head means operative to normally close the discharge port and movable to open position on upward movement of said plunger.

2. In a reciprocating plunger pump as claimed in claim 1 wherein, a. said multi-element suction inlet assembly has a tapered outer surface for removably connecting the same in said valve assembly means, and b. said independent discharge outlet assembly also has a tapered outer surface for connecting the same in said valve assembly.

3. In a reciprocating plunger pump as claimed in claim 1 wherein said multi-element suction inlet assembly means includes, a. an inner cylindrical member having on the outer periphery, a shoulder, a circular groove, and a discharge passage in the longitudinal axis thereof, b. a thimble member mounted about said inner cylindrical member and in abutment with said shoulder to form in assembled relation an open suction inlet passage radially outward, concentric and parallel to the said discharge passage, and c. said multi-element suction inlet assembly having a tapered outer surface for removably connecting the same in said valve assembly means.

4. In a reciprocating plunger pump as claimed in claim 1 wherein, a. said valve assembly means has an annular lower section, an intermediate section, and an annular upper section serially connected to each other, b. said intermediate section having a suction inlet assembly space formed therein having a tapered wall, c. said suction inlet assembly means has a tapered outer surface for removably connecting the suction inlet assembly means in mating engagement with the suction inlet assembly space, d. said annular upper section has a discharge outlet assembly space formed therein remote and independent from said suction inlet assembly space and having a tapered wall, and e. said discharge outlet assembly means has a tapered outer surface for removably connecting the discharge outlet assembly in mating engagement with the discharge outlet assembly space.

5. In a reciprocating plunger pump as claimed in claim 4 wherein the multi-element suction inlet assembly includes, a. an inner cylindrical member having, a discharge passage end to end therethrough, and on the outer periphery, a shoulder, and a circular groove therein, b. a thimble member mounted about said inner cylindrical member and in abutment with said shoulder to form in assembled relation, a circular suction inlet passage radially outward, concentric and parallel to the said discharge passage.

6. In a reciprocating plunger pump as claimed in claim 5 wherein, a. said inner cylindrical member and thimble member in assembled position forming a suction inlet port, b. said circular suction inlet passage disposed to communicate freely with said suction inlet port, c. means at the associate ends of the inner cylindrical member and the thimble member disposed about the suction inlet port to form a suction inlet valve seat, and d. said suction inlet valve head means operable to coact with said suction inlet valve seat to open and close said suction inlet port.

7. In a reciprocating plunger pump having at least one pumping chamber, a plunger designed for reciprocating movement in said plunger chamber, means for delivering fluid to be pumped, and means for passing pumped fluid from said reciprocating plunger pump, the combination with said pumping chamber of a liquid end valve assembly including in series, a. an annular lower section, b. an annular intermediate section, and c. an annular upper section on the side of said intermediate member remote from said annular lower section, d. discharge passage means extending end to end through said valve assembly in the axis of said pumping chamber, e. said intermediate section defining a suction inlet assembly space, f. a two piece suction inlet assembly means removably connected in said suction inlet assembly space, g. said annular upper section defining a discharge outlet assembly space, h. discharge outlet assembly means having, a discharge port removably connected in said discharge outlet assembly space remote and independent from the suction inlet assembly means, and i. said section inlet assembly means having an inner cylindrical member and a thimble member disposed about the inner cylindrical member to define a relatively wide suction inlet passage and a relatively wide suction inlet port radially outward of, concentric and parallel to the said discharge passage means, j. a suction inlet valve head means operatively mounted in said valve assembly to open and close said suction inlet port, and k. a discharge outlet valve head means operatively mounted in said valve assembly to open and close said discharge port.

8. In a reciprocating plunger pump as claimed in claim 7 wherein, a. said annular lower section has an inlet chamber in the axis of said pumping chamber between the pumping chamber and the discharge passage means, b. spring means in said inlet chamber disposed to coact with the suction inlet valve head means to maintain the suction inlet port normally closed, c. a spring supporting spider mounted in said inlet chamber, and d. sail spring means connected in said spring supporting spider.

9. In a reciprocating plunger pump as claimed in claim 7 including, a. spring means coacting with the discharge outlet valve head to maintain the discharge outlet port normally closed, and b. spring cage means connected in said valve assembly for supporting and holding said spring means in assembled position.

* * * * *